United States Patent [19]

Nakata et al.

[11] Patent Number: 4,904,899

[45] Date of Patent: Feb. 27, 1990

[54] PROJECTION CATHODE RAY TUBE

[75] Inventors: Michio Nakata, Takasago; Tsunehiko Sugawara, Chiba, both of Japan

[73] Assignee: Asahi Glass Company Ltd., Tokyo, Japan

[21] Appl. No.: 211,058

[22] Filed: Jun. 24, 1988

[30] Foreign Application Priority Data

Jun. 26, 1987 [JP] Japan ..... 62-157844
Jun. 26, 1987 [JP] Japan ..... 62-157845

[51] Int. Cl.[4] ..... H01J 31/00

[52] U.S. Cl. ..... 313/477 R; 313/478; 313/474; 358/250

[58] Field of Search ..... 313/477 R, 478, 461, 313/474; 358/60, 237, 250; 220/2.1 A, 2.3 A

[56] References Cited

U.S. PATENT DOCUMENTS 4,021,850 5/1977 Rogers ..... 313/477 R X
4,029,898 6/1977 Belentepe et al. ..... 220/2.1 A X
4,683,398 7/1987 Vriens et al. ..... 313/474
4,731,557 3/1988 Asano et al. ..... 313/477 R X
4,755,868 7/1988 Hodges ..... 313/477 R X

*Primary Examiner*—Donald J. Yusko
*Assistant Examiner*—Michael Horabik
*Attorney, Agent, or Firm*—Oblon, Spivak, McClelland, Maier & Neustadt

[57] ABSTRACT

A projection cathode ray tube which comprises a glass bulb consisting of a funnel portion having a large opening at one side and a small opening at the opposite side, a panel portion which has the inner surface protruded in a convex form toward the interior of the cathode ray tube and which is sealingly attached to the large opening of the funnel portion, and a neck portion receiving therein an electron-gun, which is sealingly attached to the small opening of the funnel portion, wherein the inner surface protruded in a convex form of the panel portion is polished. A sealing surface in the panel portion does not protrude from a useful screen area in the inner surface of the panel portion. At least three reference points may be provided either on the funnel portion or on the panel portion, or on both of them.

7 Claims, 5 Drawing Sheets

PROJECTION CATHODE RAY TUBE

BACKGROUND OF THE INVENTION

1. Field of the Invention

The present invention relates to a projection cathode ray tube used for a color projection television set and so on.

2. Discussion of Background

The basic construction of a conventional projection display device using a cathode ray tube is such that an electron beam emitted from an electron-gun excites a fluorescent material in a phosphor screen having a relatively small dimension which is formed in the cathode ray tube, and thus obtained light emission on the phosphor screen is projected on a relatively large screen through an optical lens/disposed in the vicinity of and in front of the cathode ray tube to thereby obtain an enlarged picture image.

In such a projection cathode ray tube, a high light-output is required in comparison with a usual direct-view cathode ray tube in order to enlarge a picture image. For this reason, various techniques have been used. As an example, by utilizing the fact that light emitted from the phosphor screen has a cosine distribution in accordance with the so-called Rule of Lambert, the amount of light gathered by a lens can be increased by inclining a normal line on the phosphor screen to the optical axis of an optical system disposed in the vicinity of and in front of a panel. Accordingly, it is preferable that the inner curved surface of a panel portion has a part spherical surface or a curved surface of non-spherical shape protruded toward the electron-gun which emits the electron beam.

The optical system disposed in the vicinity of and in front of the cathode ray tube has a plurality of lens which are arranged in consideration of correction of aberration and other problems, in which a concave lens is disposed just before the cathode ray tube to effect correction of a curved image. However, when an angle formed between the screen and the electron-gun is large, it is impossible to effect a sufficient correction by the lens. Accordingly, it is effective that the fluorescent screen formed on the curved surface of the panel portion, when it is viewed from the electron-gun, is in a convex form as shown in FIG. 8.

FIG. 7 shows an example of the construction in combination of a conventional projection cathode ray tube having the panel portion with the inner surface of a convex form and an optical system. A glass bulb 1 is constituted by a funnel portion 3 having a large opening at one side and a small opening at the opposite side, a panel portion 2 sealingly attached to the large opening of the funnel portion 3 which has an inner surface 5 curved in a convex form in view from the direction of the electron-gun wherein a fluorescent screen 6 is formed on the inner surface 5, and a neck portion 4 receiving therein an electron-gun 40 which is sealingly attached to the small opening of the funnel portion 3.

The fluorescent screen 6 formed on the inner surface 5 curved in a convex form of the panel portion 2 emits light by striking on it an electron beam emitted from the electron-gun 40 received in the neck portion 4. Although a high light-output can be obtained by increasing an input power to the cathode ray tube, the input power undergoes restriction due to possibly breaking of the glass bulb and reduction in the life time of a fluorescent material due to heat generation, thermal characteristics of the projection lens, and so forth. In view of the problems, there is such a method that a structure for cooling a face 12 of the panel portion 2 by liquid to thereby realize a high light-output. Namely, a sealed chamber 34 is formed between a concave lens 21 constituting an optical system 20 having an optical axis 22 and the face 12 of the panel portion 2, and a liquid refrigerant 32 such as an aqueous solution of ethylene glycol having the same refractive index as glass is filled in the sealed chamber 34. In more detail, the sealed chamber 34 is defined by a flat surface of the concave lens 21 disposed at an end of a container 23 with a flange 24 in which a set of lenses is held against the face 12 of the panel portion 2 facing the flat surface of the convex lens 21 with a gap, a heat conductive bracket 31 made of aluminum with heat radiation fins 36, which is disposed between the convex lens 21 and the face 12 of the panel portion 2, which functions as a spacer, and pieces of adhesive 35 such as silicone resin disposed in a gap 45 between the heat conductive bracket 31 and the convex lens 21 and in a gap 46 between the face 12 of the panel portion 2 and the heat conductive bracket 31 to effect sealing of them. As shown in FIG. 9, the panel portion 2 is formed by filling molten glass 101 in a bottom mold 301, followed by pressing the molten glass 101 by a plunger mold 201, after which the glass is cooled for solidification. In consideration of making the operation of the plunger mold 201 easy and application of a stress load to the panel portion given by the atmospheric pressure, a side wall referred to as a skirt 8 is formed by retracting a sealing surface 9 from the inner surface 5 of the panel portion 2 toward the funnel portion 3. Generally, a useful screen area of the panel portion which can effectively display a picture image has a substantially rectangular shape in which the ratio of a vertical side to a lateral side is about 1:1–16:9. Accordingly, the outer contour of the sealing plane which is formed in the vicinity of the effective plane resembles that shape to thereby minimize the volume of the cathode ray tube.

In the cathode ray tube using the glass bulb having the above-mentioned construction, it is necessary that accuracy in the curvature of the inner surface of the panel portion is in an optically sufficient range in order to obtain the advantage of the panel portion having the curved portion in a convex form and good optical characteristics. Further, it is essential that the central axis of the optical lens formed by curving the inner surface of the panel portion in a convex form is optically in alignment with the optical axis of the optical system.

The inner surface of the panel portion which is formed by a method of pressing mold is apt to cause fluctuation of the curvature due to unstableness of the curved surface formed in a heated metal mold and unstableness of the behavior of glass under application of heat during cooling and solidifying of the glass. Further, inclination of the curved surface and deviation of the center of the curved surface may easily take place owing to errors in the metal molds, the pressing machine, and so on.

In order to eliminate such problems, the inner surface formed by press molding may be finished by mechanically polishing it to have a predetermined curved surface. However, since the skirt 8 and the sealing surface 9 extending toward the funnel portion 3 have a substantially rectangular contour as described before, it is impossible to polish entirely the effective plane. In this case, the area of the inner surface which does not contribute radiation of light greatly expands, and it is necessary to form the outer contour of the sealing surface 9 in a substantially circular shape rather than in a rectangular shape. Namely, in the construction of the conventional glass bulb, the volume of the cathode ray tube is greatly increased in order to increase accuracy of the curvature of the inner surface to be in an optically allowable range by mechanically polishing the inner surface.

In addition, when the cathode ray tube is once assembled, it is difficult to align the optical axis of the optical system with the central axis of the inner surface of the panel portion, and an inclination angle of the axis $\Delta\theta$ and a deviation of the axis $\delta$ may be caused as shown in FIG. 7, which deteriorate the optical characteristics of the cathode ray tube.

OBJECTS OF THE INVENTION

It is an object of the present invention to provide a lens having excellent optical characteristics which is formed in the face of the panel portion of a cathode ray tube by polishing the inner surface of the face of the panel portion.

It is another object of the present invention to provide a projection cathode ray tube having a panel portion which has an inner surface having an optically sufficient range in accuracy of the curvature and protruding in a convex form toward the interior of the cathode ray tube while the volume of the tube is minimized.

It is another object of the present invention to provide the combination of a projection cathode ray tube and an optical system arranged in the vicinity of the inner surface of the panel portion of the cathode ray tube in which an optically sufficient positional relation is easily determined.

SUMMARY OF THE INVENTION

The foregoing and other objects of the present invention have been attained by providing a projection cathode ray tube which comprises a glass bulb consisting of a funnel portion having a large opening at one side and a small opening at the opposite side, a panel portion which has the inner surface protruded in a convex form toward the interior of the cathode ray tube and which is sealingly attached to the large opening of the funnel portion, and a neck portion receiving therein an electron-gun, which is sealingly attached to the small opening of the funnel portion, wherein the inner surface protruded in a convex form of the panel portion is polished.

Particularly, in accordance with the present invention, an optical lens having a predetermined optical axis in the face of the panel portion is formed by polishing the inner surface having a convex form.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Preferred embodiments of the projection cathode ray tube according to the present invention will be described with reference to the drawings.

Figure 1:
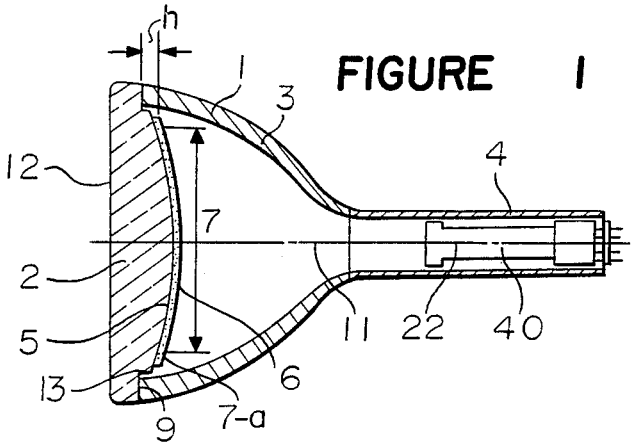
FIG. 1 is a longitudinal cross-sectional view of a first embodiment of the projection cathode ray tube according to the present invention.

FIG. 1 is a longitudinal cross-sectional view of the maximum diameter part of an embodiment of the projection cathode ray tube of the present invention. A glass bulb 1 comprises a funnel portion 3 having a large opening at one side and small opening at the opposite side, a panel portion 2 sealingly attached to the large opening of the funnel portion 3 and having an inner surface 5 protruded in a convex form toward the interior of the cathode ray tube, a fluorescent screen 6 being formed on the inner surface 5, and a neck portion 4 receiving therein an electron-gun 40 which is sealingly attached to the small opening of the funnel portion 3.

The fluorescent screen 6 is formed on the inner surface 5 of the panel portion 2 by using a coating technique such as a slurry method, a precipitation method, and so on at an area effective to display a picture image, i.e., an area beyond an effective illumination surface 7.

Figure 4:
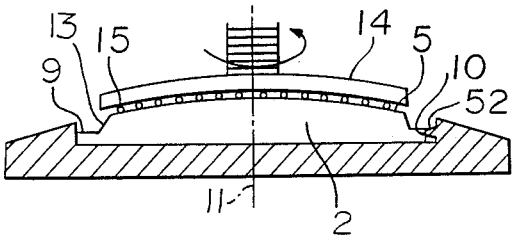
FIG. 4 is an enlarged cross-sectional view of the panel portion showing a state of polishing of the inner surface of the panel portion.

In the conventional panel, a skirt 8 formed along the outer side of the inner surface is protruded toward the funnel portion 3 from the end portion 7a of the effective plane of the inner surface 5. On the other hand, in the present invention, the sealing surface 9 is not protruded over the effective edge 7a of the inner surface 5 of the panel portion 2 as shown in FIG. 1. Namely, in the present invention, it is desirable that a skirt is not formed in the panel portion 2, and, even when it is provided on the panel portion 2, the skirt does not protrude from the effective edge of the inner surface. More preferably, the skirt does not protrude from the extension of the effective plane of the inner surface 5 so that the effective plane of the inner surface 5 of the panel portion can be smoothly polished, and a step 13 separates the inner surface 5 from the sealing surface 9 both radially and axially sufficiently so that the inner surface 5 can be polished without interference from the sealing surface 9. Accordingly, the inner surface 5 of the panel portion 2 having excellent quality in optics can be obtained by mechanically polishing the inner surface 5, around which the sealing surface 9 is formed, without any hindrance by the skirt even by using a polishing tool 14 as shown in FIG. 4.

As shown in FIG. 1, the step 13 formed at the circumferential portion of the effective illumination surface 7 has a height h that eliminates occurrance of scratches and cutting of the inner surface 5 when it is polished by the polishing tool 14. Since the inner surface is in a convex form, the height of the step 13 decreases in the longer side of the panel portion having the substantially rectangular shape rather than the shorter side. However, the sealing surface 9 is formed at the same level. Accordingly, in order to eliminate the problem of reduction in the quality on the sealing surface 9 caused by scratches and cutting, it is desirable to form the step 13 between the end portion 7*a* and the sealing surface 9. Specifically, the step 13 should have a height of 0.5 mm or greater, more preferably in a range of 0.5 mm–2 mm in consideration of the structure and accuracy of the polishing tool.

Although the width of the sealing surface and the thickness of the sealing portion should have a sufficient strength against the atmospheric pressure, it is difficult to specify the numerical values because they depend on the surface area of the cathode ray tube and the shape of the glass bulb 1. For instance, when a cathode ray tube having a maximum outer diameter of about 180 mm and a curvature of the inner surface of the panel portion of about R600 is used, the thickness and width of the sealing portion should be 4 mm or more.

Figure 5A:
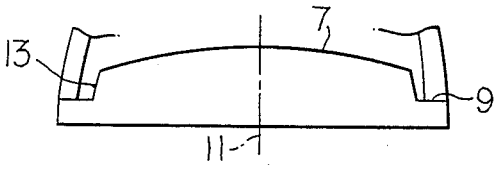
FIGS. 5a–5c are respectively diagrams in cross-section showing separate embodiments of the panel portion.
Figure 5B:
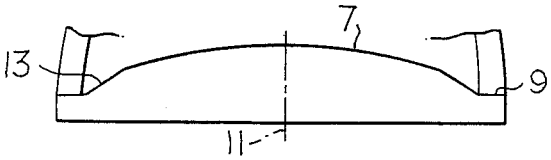
Figure 5C:
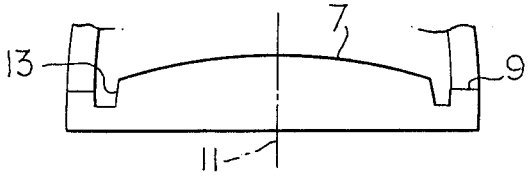
Figure 6:
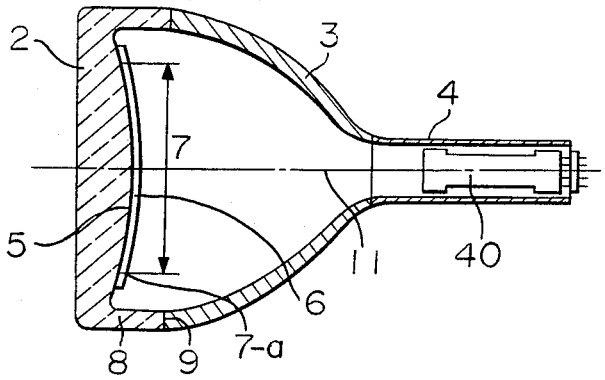
FIGURE 6 PRIOR ART
FIG. 6 is a longitudinal cross-sectional view of a conventional projection cathode ray tube having the panel portion with an inner surface protruded in a convex form.

A connecting portion to connect the effective illumination surface 7 and the sealing surface 9 does not contribute to displaying a picture image, and it is not necessary to consider accuracy of the curvature. Accordingly, various configurations as shown in FIGS. 5*a*–5*c* can be considered. In the inner surface of the panel portion 2 as shown in FIG. 5*c*, the sealing surface 9 is far separated from the effective illumination surface 7 to cause increase of the volume of the cathode ray tube. However, it may be used when a bulged shape at the sealing portion is considered to be important.

The panel portion 2 is formed by press molding followed by polishing the inner surface 5 in a convex form by using the polishing tool 14 and a polishing material 15 as shown in FIG. 4.

Figure 7:
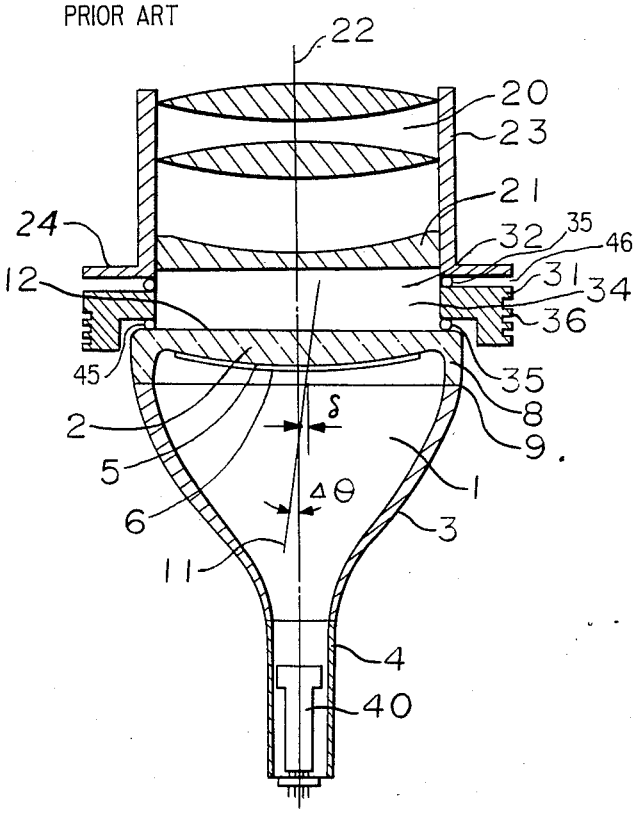
FIGURE 7 PRIOR ART
FIG. 7 is a longitudinal cross-sectional view of a conventional projection cathode ray tube and an optical system attached thereto.
Figure 8:
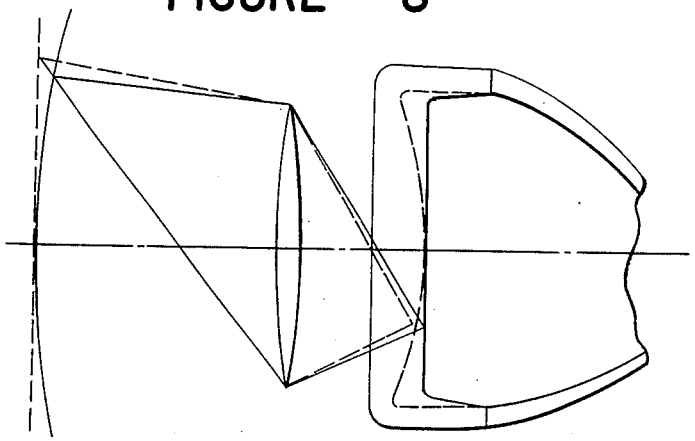
FIG. 8 is a diagram showing a relation of the shape of the panel portion with a fluorescent screen to an image formed on the screen.
Figure 9:
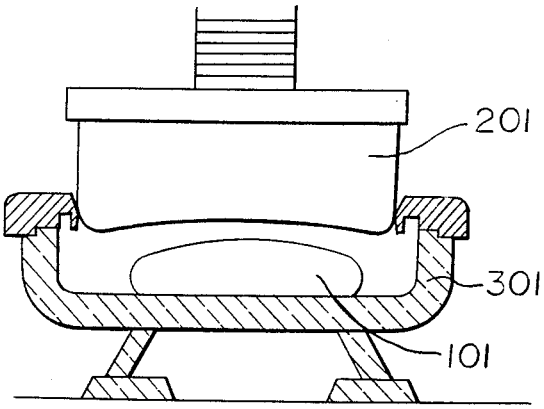
FIG. 9 is a diagram in cross-section showing the operation of a pressing mold to form a panel portion.
Figure 10:
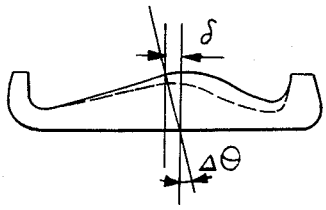
FIG. 10 is a side view of a panel portion showing inclination of the curved surface and deviation of the center of the curved surface.

In the polishing operation, positioning of the central axis 11 of the inner surface is carried out as follows. The face 12 of the panel portion 2 is put on a surface plate on a polishing table, and reference points 10 provided at three positions at two sides adjacent to each other which constitute part of the substantially rectangular contour of the panel are made in correspondence to striking portions 52 formed on the polishing table so that the panel portion 2 is fixed on the table. Then, the face of the panel portion 2 is formed into an optical lens having a predetermined optical axis. Generally, an air gap formed between the optical system 20 and the projection cathode ray tube is used as the sealed chamber 34 in which the liquid refrigerant 32 such as aqueous solution of ethylene glycol having the same refractive index as glass is filled. Accordingly, it is not always necessary to polish the face 12 of the panel portion 2. However, it is desirable that the face 12 is polished prior to polishing the inner surface because accuracy in dimension between the reference points 10 and the face 12 affects accuracy in positioning the central axis 11 in the inner surface 5. When the inner surface 5 is polished after the panel is positioned with reference to the reference points 10, a convex surface can be correctly formed, and there is obtainable a specific positional relation between the reference points 10 and the central axis 11 of the inner surface 5 of a convex form and between a reference plane defined by the three reference points 10 and the inner surface 5 in the convex form. Accordingly, problems of the deviation $\delta$ and the inclination $\Delta\theta$ of the central axis 11 in the inner surface 5 as shown in FIG. 7 can be eliminated.

Figure 2:
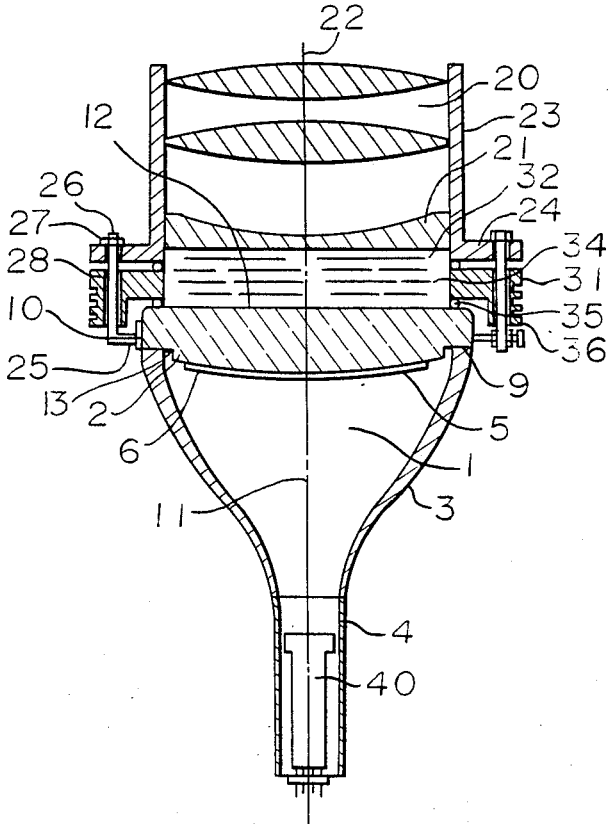
FIG. 2 is a longitudinal cross-sectional view of a second embodiment of the projection cathode ray tube with an optical system according to the present invention.

FIG. 2 is a longitudinal cross-sectional view showing a basic construction in the combination of the project cathode ray tube and an optical system 20 according to the present invention. In FIG. 2, the same reference numerals as in FIG. 1 designate the same or corresponding parts, and therefore, description of these parts is omitted. The glass bulb 1 comprises the funnel portion 3 having a large opening at one side and a small opening at the opposite side, the panel portion 2 having the inner surface 5 protruded in a convex form toward the interior of the funnel portion 3, which is sealingly attached to the large opening of the funnel portion 3, and the neck portion 4 receiving therein the electron-gun 40, which is sealingly attached to the small opening of the funnel portion 3.

The fluorescent screen 6 is formed on the inner surface 5 of the panel portion 2 and emits light by striking an electron beam emitted from the electron-gun 40 positioned in the neck portion 4.

Three reference points 10 are provided at appropriate positions in the side surface of the panel portion 2, and they are used for determination of position when the inner surface of the panel portion 2 is polished.

The reference points 10 are also used for putting a reference end of a fitting piece 25 which is used when the optical system 20 is connected to the glass bulb 1. Namely, the optical system 20 may be connected to the glass bulb 1 by connecting them with an appropriate means in such a manner that the flange 24 formed in the container 23 is connected to the panel portion 2 having the side surface in which the reference points 10 are provided by means of the fitting piece 25, bolts 26, and nuts 27. Fastening of the panel portion 2 can also be attained by means of the bolts 26, the nuts 27, and the fitting piece 25 at such positions that the sides, in which reference points 10 are provided to fit the fitting piece 25, face the longer side and the shorter side. Thus, by connecting the optical system 20 and the glass bulb 1 in one piece by means of the reference points 10, the optical axis 22 of the optical system 20 is aligned with the central axis 11 of the inner surface 5 of the glass bulb 1 (i.e., the optical axis of the optical lens formed in the face 12 of the panel portion 2) with sufficient accuracy.

Figure 3:
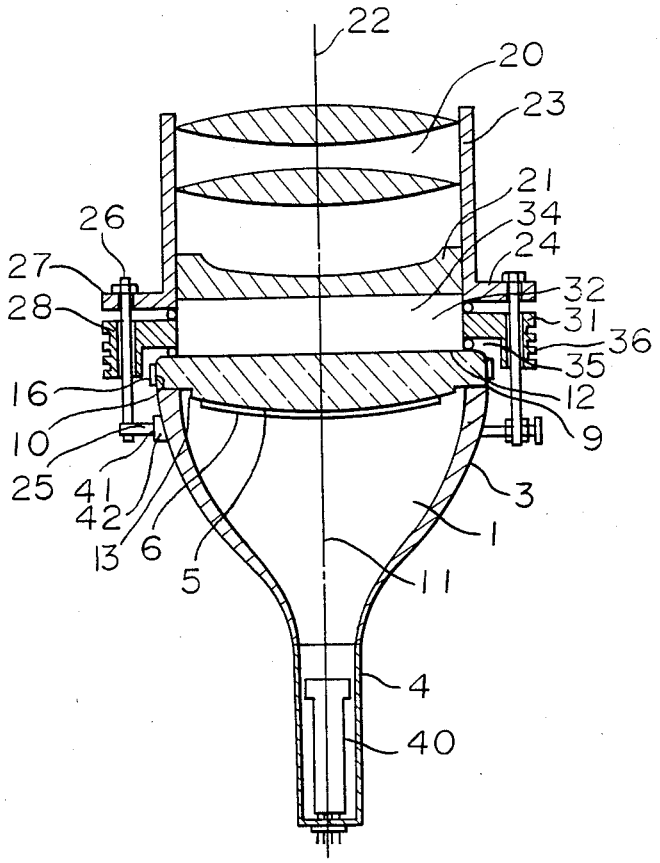
FIG. 3 is a longitudinal cross-sectional view of a third embodiment of the projection cathode ray tube with an optical system according to the present invention.

FIG. 3 shows another embodiment of the present invention. In this embodiment, the optical system 20 is made in one piece with the glass bulb 1 at the funnel portion 3, and the optical axis 22 of the optical system 20 is made in coincidence with the central axis 11 of the inner surface 5 of the panel portion 2 by the same method as in the above-mentioned embodiment is used.

In the projection cathode ray tube, it is preferable that damage of the glass bulb 1 is avoided by reinforcing the side surface of it because a stress by vacuum acts on the glass bulb 1, and a thermal stress is relatively large when in use. Accordingly, when a reinforcing band 16 is provided at the side surface of the panel portion 2, it is necessary to pass on the reference points 10. Accordingly, the shape of the reinforcing band 16 is complicated, and the width of the reinforcing band 16 should be narrowed.

In this embodiment, three reference points 41 are provided respectively on three projections 42 formed on the funnel portion 3 at positions near the sealing surface 9 between the panel portion 2 and the funnel portion 3 so as to face the reference points 10 on the panel portion 2. Then, the panel portion 2 having the inner surface 5 of a convex form is sealingly connected to the funnel portion 3 by using the same method as in the above-mentioned embodiment so that the positional relation between the reference points 10 and the reference points 41 is specified. In this case, sealing operation may be conducted by using a sealing tool in the same manner as a direct observation type color cathode ray tube which is sealed by using powder glass for sealing. As a result of sealing, the positional relation between the reference points 41 on the projections 42 formed on the funnel portion 3 and the inner surface 5 of a convex form of the panel portion 2 is specified by the reference points 10 of the panel portion 2.

Then, the reinforcing band 16 is wound on the skirt at the side of the panel portion, whereby it is possible to unify the optical system 20 at the reference points 10 of the panel portion 2, and the optical system is connected to the funnel portion 3 at the reference points 41 by means of the bolts 26, the nuts 27, and the fitting piece 25 in the same manner as the above-mentioned embodiment to thereby unify the optical system 20 with the glass bulb 1. Namely, the central axis 11 of the inner surface 5 in a convex form of the panel portion 2 is in alignment with the optical axis 22 of the optical system 20 at the funnel portion 3 through the reference point 41 on the projections 42 formed near the sealing surface 9.

Further, when the neck portion 4 is sealingly attached to the funnel portion 3 and the electron-gun 40 is sealingly contained in the neck portion 4, by using the reference points 41 on the projections 42, the central axis 11 of the funnel portion 3, the neck portion 4, and the electron-gun 40 are entirely aligned with the optical axis 22 of the optical system 20 and the central axis 11 of the inner surface 5 of the panel portion 2 to thereby provide sufficient optical characteristics.

As described above, by mechanically polishing the inner surface 5 in a convex form of the panel portion 2, the projection cathode ray tube having a minimum volume with respect to the glass bulb 1 and having sufficient accuracy in optics of the inner surface of the convex form can be obtained. In the present invention, accuracy of the radius of curvature of the inner surface 5 formed by mechanically polishing can be in the range of 5 μm–20 μm, which assures improved optical characteristics in the projection cathode ray tube in comparison with a conventional inner surface having a curvature in the range of 100 μm–300 μm.

Further, it is possible that the optical axis of the optical system is easily in coincidence with the central axis of the curved surface of the panel portion through three reference points formed on the panel portion or its side area and three reference points formed on the funnel portion so as to face these reference points. Accordingly, a problem of a curved image on a screen can be corrected by forming the inner surface of the panel portion into a convex form.

Obviously, numerous modifications and variations of the present invention are possible in light of the above teachings. It is therefore to be understood that, within the scope of the appended claims, the invention may be practiced otherwise than as specifically described herein.

What is claimed is:

1. A projection cathode ray tube which comprises a glass bulb having a central axis, said glass bulb comprising:

(a) a funnel portion having:
  (i) a large opening at one side and
  (ii) a small opening at the opposite side;

(b) a neck portion which:
  (i) receives therein an electron-gun and
  (ii) is sealingly attached to said small opening of said funnel portion; and (c) a panel portion which:
  (i) has a sealing surface which is sealingly attached to said large opening of said funnel portion;
  (ii) has an inner surface protruded in a convex form toward the interior of said glass bulb;
  (iii) has a fluorescent screen on said inner surface; and
  (iv) has a step separating said inner surface from said sealing surface both radially and axially sufficiently so that said inner surface can be polished so as to form an optical lens without interference from said sealing surface.

2. A projection cathode ray tube as recited in claim 1 and further comprises an optical system having an optical axis mounted on said glass bulb so that said optical axis coincides with said central axis.

3. A projection cathode ray tube as recited in claim 1 wherein said panel portion has a substantially rectangular contour.

4. A projection cathode ray tube as recited in claim 3 wherein at least three reference points are provided on two sides of said rectangular contour adjacent to each other.

5. A projection cathode ray tube as recited in claim 4 wherein said at least three reference points are provided on protrusions protruded from side surfaces of said panel portion.

6. A projection cathode ray tube as recited in claim 1 wherein said step has a height of 0.5 mm or greater.

7. A projection cathode ray tube as recited in claim 1 wherein said step has a height in the range of 0.5 mm–2 mm.

* * * * *